US006684467B1

(12) United States Patent
Walker

(10) Patent No.: US 6,684,467 B1
(45) Date of Patent: Feb. 3, 2004

(54) REUSABLE COFFIN

(76) Inventor: Harold D. Walker, 3706 S. Jefferson Ave., St. Louis, MO (US) 63118

( * ) Notice: Subject to any disclaimer, the term of this patent is extended or adjusted under 35 U.S.C. 154(b) by 0 days.

(21) Appl. No.: 10/234,937

(22) Filed: Sep. 4, 2002

(51) Int. Cl.[7] ..... A61G 17/00
(52) U.S. Cl. ..... 27/35; 52/133
(58) Field of Search ..... 27/35, 27, 4, 16, 27/17; 52/133

(56) References Cited

U.S. PATENT DOCUMENTS 3,133,334 A * 5/1964 Johnsen ..... 27/27
3,654,676 A * 4/1972 McHugh ..... 27/2
3,810,282 A * 5/1974 Doggett ..... 27/35
4,177,543 A * 12/1979 Angermann ..... 27/35
4,237,590 A * 12/1980 Work ..... 27/35
4,249,289 A * 2/1981 Work ..... 27/35
4,372,018 A * 2/1983 Miller et al. ..... 27/35
4,788,757 A * 12/1988 Bethune et al. ..... 27/2
4,823,448 A * 4/1989 Martin ..... 27/35
5,481,785 A * 1/1996 Minton et al. ..... 27/27
5,548,880 A * 8/1996 Harb ..... 27/2
5,956,825 A * 9/1999 McCoy et al. ..... 27/2
6,385,824 B1 * 5/2002 Schwartz ..... 27/35

* cited by examiner

*Primary Examiner*—William L. Miller

(57) ABSTRACT

A reusable coffin has a casket and a vault. The casket has a headwall, a footwall, a left and a right sidewall, a first and a second lid, and a bottom. The right sidewall, and first and second lids have hinges. The headwall and the footwall have a latching means to secure the right sidewall. The vault fits closely within the casket to form a reusable coffin. The vault has a headwall, a footwall, a left and a right sidewall, a first and a second lid with hinges, and a bottom. The vault displays a deceased person with dignity.

10 Claims, 4 Drawing Sheets

REUSABLE COFFIN

BACKGROUND OF THE INVENTION

1. Field of the Invention

The present invention relates to a reusable coffin for use in connection with burial coffins. The reusable coffin has particular utility in connection with a casket separated from the vault and reused.

2. Description of the Prior Art

Each life comes to an end. After display and viewing of a deceased person, a funeral proceeds to a cemetery. A typical funeral ends with a casket lowered into the earth. A crew later returns to backfill the grave. In lieu of burial, the casket and the deceased are cremated. In both funeral methods, the casket has one use only for a single deceased person. As generally known, the casket price makes up the predominant cost of a funeral. Reusable coffins are desirable for persons and families of modest means to save on funeral expenses yet provide a dignified funeral for a loved one. In a reusable coffin, the casket has the elegance and ornamentation of more expensive caskets while the less expensive vault carries the deceased to the final resting place.

In the following description, the term "coffin" describes the entire invention and the term "casket" describes the outer reusable part of the invention, often ornately decorated. These terms often have synonymous use in the art.

The use of caskets is known in the prior art. For example, U.S. Pat. No. 5,956,825 to McCoy et al. discloses a casket assembly that permits lowering of a liner beneath the casket. However, the McCoy '825 patent does not fold down a side of the casket, and has further drawbacks of no casket bottom and extensible pads.

U.S. Pat. No. 5,481,785 to Minton et al. discloses a casket assembly that surrounds a capsule. The Minton '785 reveals a V shaped matching tongue and groove joint on the capsule lid and body with a sealant in the groove. However, the Minton '785 patent does not have a two part capsule lid, and additionally does not have a bottom on the casket.

Similarly, U.S. Pat. No. 3,815,185 to Owens discloses a reusable outer casket that surrounds an inner coffin with detachable ornamented walls. However, the Owens '185 patent does not have a fold down side and an integral lid for the coffin, and cannot have a bottom.

Similarly, U.S. Pat. No. 5,592,723 to Leijonhufvud et al. discloses a burial coffin arrangement that surrounds an inner casket and secures the inner casket by a wedge shaped cross section. However, the Leijonhufvud '723 patent does not fold down a sidewall, and does not have a split lid on the inner casket.

Similarly, U.S. Pat. No. 4,962,574 to Estes discloses a display casket that has decoration suitable for both genders. However, the Estes '574 patent does not have a fold down side, and cannot have a separate inner capsule.

Similarly, U.S. Pat. No. 3,654,676 to McHugh discloses an outer casket that surrounds a capsule. However, the McHugh '676 patent does not have a fold down side, and cannot have a bottom.

Lastly, U.S. Pat. No. Des. 420,194 to Cummings discloses a casket that has a split lid. However, the Cummings '194 patent lacks a separate vault.

While the above-described devices fulfill their respective, particular objectives and requirements, the aforementioned patents do not describe a reusable coffin that allows a casket to be separated from the vault and reused. The McCoy '825 patent makes no provision for a fold down side of a casket. The Minton '785 patent makes no provision for a two-part casket lid. The Owens '185 patent lacks a fold down side of a casket. The Leijonhufvud '723 patent makes no provision for a two-part casket lid. The Estes '574 patent lacks an inner capsule and a fold down side of a casket. The McHugh '676 patent lacks a bottom of a casket. The Cummings '194 patent makes no provision for a separate vault.

Therefore, a need exists for a new and improved reusable coffin that can be used for a casket separated from the vault and reused. In this regard, the present invention substantially fulfills this need. In this respect, the reusable coffin according to the present invention substantially departs from the conventional concepts and designs of the prior art, and in doing so provides an apparatus primarily developed for the purpose of a casket separated from the vault and reused.

SUMMARY OF THE INVENTION

In view of the foregoing disadvantages inherent in the known types of caskets now present in the prior art, the present invention provides an improved reusable coffin, and the above-mentioned disadvantages and drawbacks of the prior art. As such, the general purpose of the present invention, which will be described subsequently in greater detail, is to provide a new and improved reusable coffin and method which has all the advantages of the prior art mentioned heretofore and many novel features that result in a reusable coffin which is not anticipated, rendered obvious, suggested, or even implied by the prior art, either alone or in any combination thereof.

To attain this, the present invention essentially comprises a reusable coffin having a casket and a vault. The casket has a parallel headwall and a footwall, a parallel left sidewall and a right sidewall, a first lid, a second lid, and a bottom interconnected to form a container. The right sidewall of the casket has one or more hinges. The headwall and the footwall of the casket each have a latching means to temporarily secure the right sidewall. The first lid and the second lid of the casket each have one or more hinges. The vault fits closely within the casket for temporary placement so as to form a reusable coffin. The vault has a parallel headwall and a footwall, a parallel left sidewall and a right sidewall, a first lid, a second lid, and a bottom. The vault receives and displays a deceased person in a dignified manner.

In addition, the first lid and the second lid of the vault have inner ends located proximate to the center of the vault. The first lid and the second lid have overlapping lips extending from the inner ends. The second lid has a sealant protected by a strip. At the conclusion of funeral services, the strip is removed, allowing the lip of the first lid to seal upon the lip of the second lid prior to final disposition of the vault.

There has thus been outlined, rather broadly, the more important features of the invention in order that the detailed description thereof that follows may be better understood and in order that the present contribution to the art may be better appreciated.

The invention may also include on the casket, latching means as rotating clasps, handles on the sidewalls, and construction from a variety of materials suitable for ornamentation and first and second lids hinged to the left sidewall for independent opening. On the vault, the invention may also include first and second lids hinged to left sidewall for independent opening, first and second lids with sealing lips, a variety of sealants protected by a strip, a hermetic seal, and construction from a variety of materials suitable for interment and contact with a deceased person. There are, of course, additional features of the invention that will be described hereinafter which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved reusable coffin that has all of the advantages of the prior art caskets and none of the disadvantages.

It is another object of the present invention to provide a new and improved reusable coffin that may be easily and efficiently manufactured and marketed.

An even further object of the present invention is to provide a new and improved reusable coffin that has a low cost of manufacture with regard to both materials and labor, and which accordingly is then susceptible of low prices of sale to the consuming public, thereby making such reusable coffin economically available to the buying public.

Still another object of the present invention is to provide a new reusable coffin that provides in the apparatuses and methods of the prior art some of the advantages thereof, while simultaneously overcoming some of the disadvantages normally associated therewith.

Even still another object of the present invention is to provide a reusable coffin for a casket separated from the vault and reused. This allows reduction in the cost of funerals by use of an inexpensive vault.

Still yet another object of the present invention is to provide a reusable coffin for a casket separated from the vault and reused. This makes it possible to provide a vault that may be moved independently of the casket.

Still yet another object of the present invention is to provide a reusable coffin for a casket separated from the vault and reused. This makes it possible to seal a two-part vault lid.

Lastly, it is an object of the present invention to provide a new and improved method of reusing a coffin with the following the steps:

1) raising the first and second lids of a casket, 2) opening the right sidewall of the casket upon hinges, 3) placing a vault through the opening left by the folded right sidewall, 4) closing the right sidewall of the casket, 5) raising the first and second lids of the vault to receive and to view the deceased, 6) following services, closing the first and second lids of the vault, 7) opening the right sidewall of the casket, 8) removing the vault from the casket through the opening left by the folded right sidewall, and 9) closing the right sidewall of the casket.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
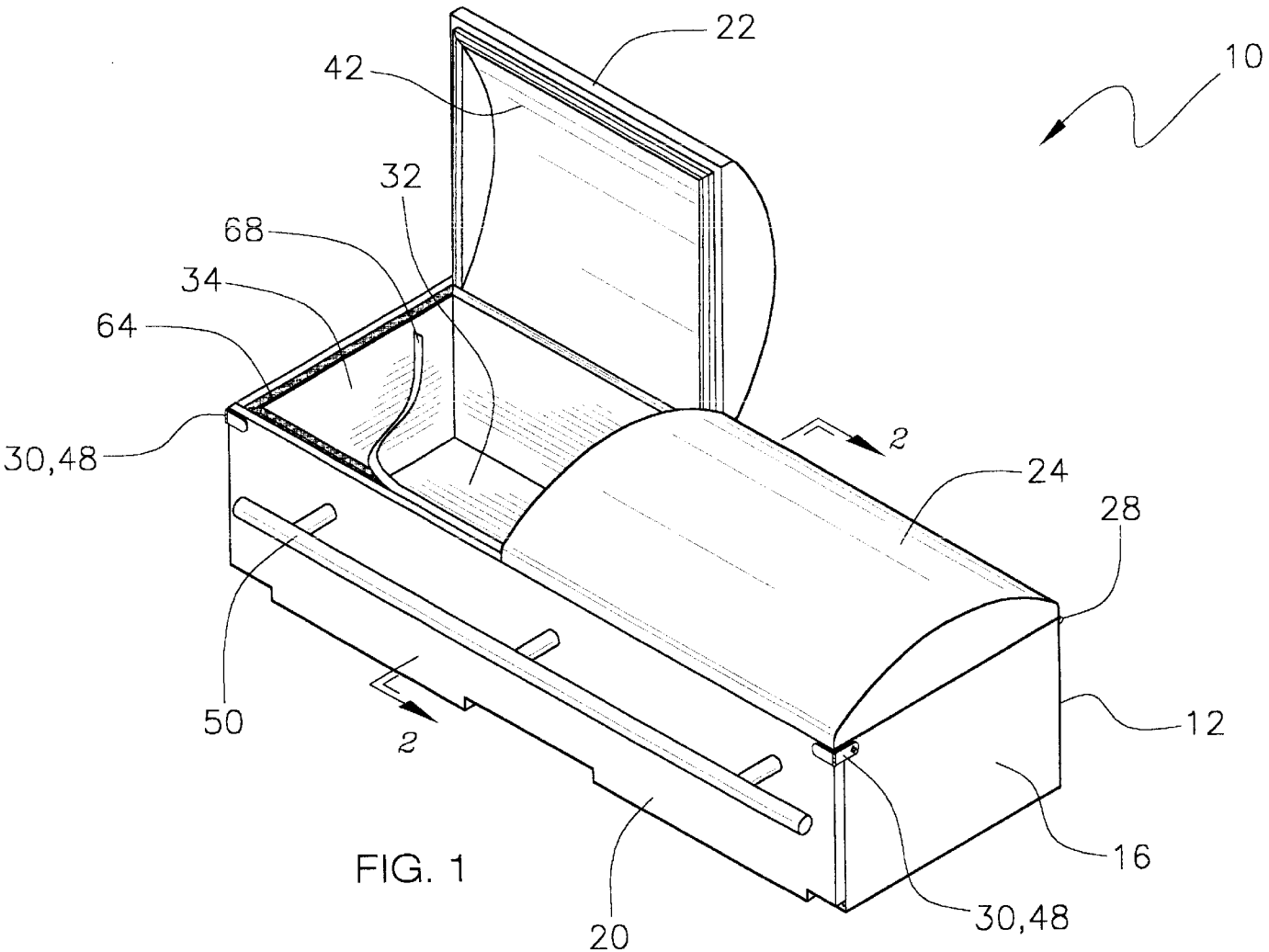
FIG. 1 is an oblique view of the preferred embodiment of the reusable coffin constructed in accordance with the principles of the present invention.
Figure 3:
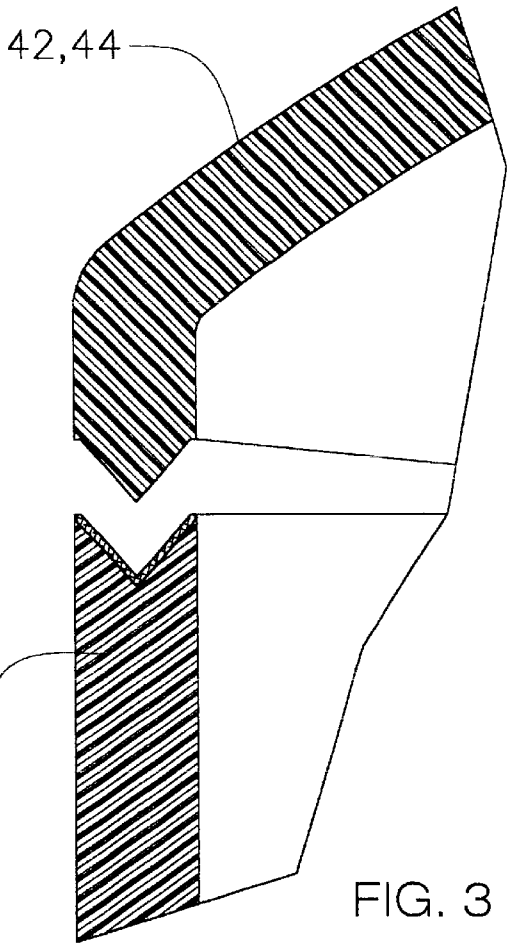
FIG. 3 is a detail view of the common in the art vault lid and wall seal with V shaped groove of the reusable coffin of the present invention.

Referring now to the drawings, and particularly to FIGS. 1–5, a preferred embodiment of the reusable coffin of the present invention is shown and generally designated by the reference numeral 10.

In FIG. 1, a new and improved reusable coffin 10 of the present invention for a casket separated from the vault 32 and reused is illustrated and will be described. More particularly, the reusable coffin 10 has a casket and a tightly fitting vault 32. As part of a funeral, a deceased person is placed within the vault 32 typically facing out of the coffin 10. The parts of the invention use a deceased person as a reference point. Made of polished metal, the casket has a headwall 14 and a parallel footwall 16 spaced to accept a person of a given height. The casket has a right sidewall 20 and a parallel left sidewall 18 spaced to accept a person of a given width. The headwall 14, footwall 16, right sidewall 20, and left sidewall 18 refer to the deceased person's head, foot, and right and left sides respectively. Further, the casket has a first lid 22 and a second lid 24 that span between the left sidewall 18 and the right sidewall 20. The first lid 22 and the second lid 24 mount to one or more hinges 28 upon the left sidewall 18. The first lid 22 and the second lid 24 open independently of each other for viewing the deceased. The first lid 22 opens to reveal the deceased person's face. At the headwall 14 and footwall 16, the first lid 22 and the second lid 24 respectively have outer ends 52, 58. Opposite the outer ends 52, 58, the first lid 22 and the second lid 24 have inner ends 54, 60 that form a seam 66 upon closing the first lid 22 and the second lid 24. Opposite the lids 22, 24, the casket has a bottom 26 that joins with the headwall 14, the footwall 16, the right sidewall 20, and the left sidewall 18. The walls join with each other to form a rectangle while the bottom 26 encloses the rectangle forming a container.

The right sidewall 20 mounts upon one or more hinges 28 along the right side of the bottom 26 of the casket 12. Opposite the hinges 28, the right sidewall 20 has latching means 30 near the comers with the headwall 14 and the footwall 16. The latching means 30 secures the right sidewall 20 in an upright position closing the casket. The latching means 30 permanently affix to the right sidewall 20 and temporarily contact the headwall 14 and the footwall 16. In the preferred embodiment, the latching means 30 is a metal-hinged clasp 48 that fits over a pin in the headwall 14 and the footwall 16. Both the right sidewall 20 and the left sidewall 18 have handles 50 for carrying the deceased during funeral services.

FIG. 1 further shows the interior of the vault 32. The vault 32 fits snugly within the casket 12, matching the shape of the casket 12 closely. The vault 32 is made of recycled plastic to minimize cost. Akin to the casket 12, the vault 32 has a headwall 34 and a parallel footwall 36 spaced to accept a deceased person, a right sidewall 40 and a parallel left sidewall 38 spaced to accept a deceased person. The vault 32 has a first lid 42 and a second lid 44 that cover the deceased person. The first lid 42 and the second lid 44 mount to one or more hinges 28 upon the left sidewall 38. The first lid 42 and the second lid 44 open independently of each other for viewing the deceased person. The first lid 42 opens to reveal the deceased person's face. Opposite the lids, the vault 32 has a bottom 46 that joins with the headwall 34, the footwall 36, the right sidewall 40, the left sidewall 38 and the bottom 46 forming a closed rectangle to contain the deceased person. The deceased person rests upon the bottom 46 of the vault 32 within the walls and beneath the first lid 42 and the second lid 44.

In this figure, the headwall 34, left sidewall 38, and bottom 46 of the vault 32 appear beneath the open first lid 42 of the vault 32 and the first lid 22 of the casket 12. As common in the art, the vault 32 has a sealant 64 applied to the edges opposite the bottom 46 of the vault 32 on the headwall 34, the footwall 36, the right sidewall 40, and the left sidewall 38. A strip 68 covers the sealant 64 during a funeral. Upon removal of the strip 68, the first lid 42 and the second lid 44 close upon the headwall 34, footwall 36, the right sidewall 40, and the left sidewall 38. The sealant 64 then protects the vault 32 from contamination. In the preferred embodiment, the sealant 64 is an epoxy covered by a paper strip 68. In alternate embodiments, the sealant 64 can be epoxy, glue, resin, tar, pitch, or a contact cement while the strip 68 can be paper, metal foil, or plastic.

Figure 2:
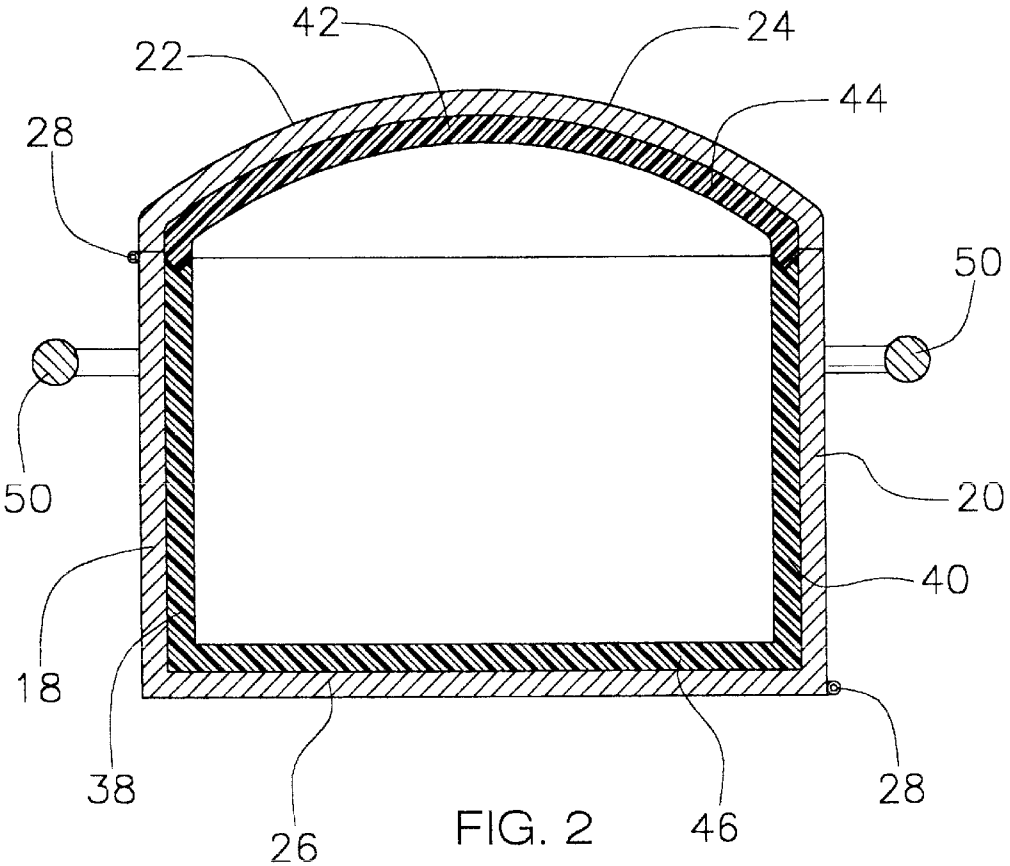
FIG. 2 is a section view perpendicular to the longitudinal axis of the reusable coffin of the present invention.

Turning to FIG. 2, the vault 32 fits snugly within the casket 12. During a funeral, upon lifting the first lid 22 and the second lid 24 of the casket, the first lid 22 and the second lid 24 of the vault 32 also open. The first lids 22, 42 and the second lids 24, 44 mount to hinges 28 upon the left sidewall 18 opposite the bottom 26. The right sidewall 20 of the casket 12 mounts to hinges 28 upon the bottom 26 of the casket 12 on the right side.

As common in the art, the vault 32 has a matching tongue and groove joint between the first lid 42, the second lid 44, the headwall 34, the footwall 36, the right sidewall 40, and the left sidewall 38 shown in FIGS. 2. & 3. The tongue has a V shape applied to the edges of the first lid 42 and the second lid 44 of the vault 32. The groove has a matching V shape with a sealant 64 applied to the edges of the headwall 34, the footwall 36, the right sidewall 40 and the left sidewall 38 opposite the bottom 46.

Figure 4:
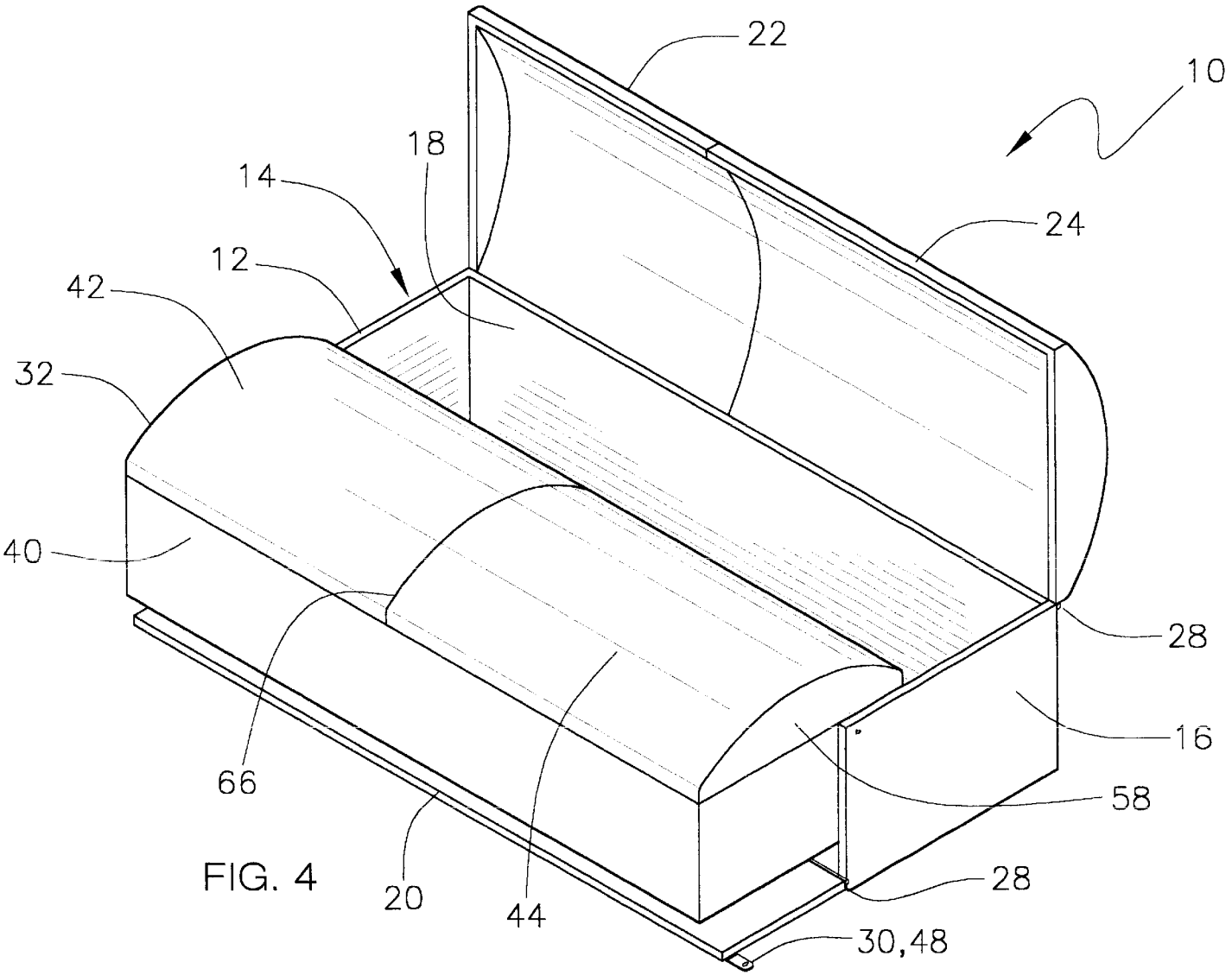
FIG. 4 is a detail view of the seal between the first lid and the second lid of the vault of the reusable coffin of the present invention.

FIG. 4 shows the vault 32 ready for final disposition of the deceased person with the first lid 42 and the second lid 44 closed. The first lid 42 and the second lid 44 have inner ends 54, 60 opposite the outer ends 52, 58. The first lid 42 of the vault 32 has a lip 56 upon the inner end 54 that extends towards the center of the invention 10 and that is coplanar with the outside surface of the first lid 42. The second lid 44 of the vault 32 has a lip 62 upon the inner end 60 that extends towards the center of the invention 10 and opposite of the lip 56 of the first lid 42. The lip 62 of the second lid 44 carries a sealant 64 that binds the lip 56 of the first lid 42 to the lip 62 of the second lid 44. The bound lip 56 of the first lid 42 and the lip 62 of the second lid 44 form a seam 66 that permits viewing of the deceased person and later hermetically sealing the vault 32 to prevent contamination. The sealant 64 extends along the entire width of the lip 62 of the second lid 44 of the vault 32.

Figure 5:
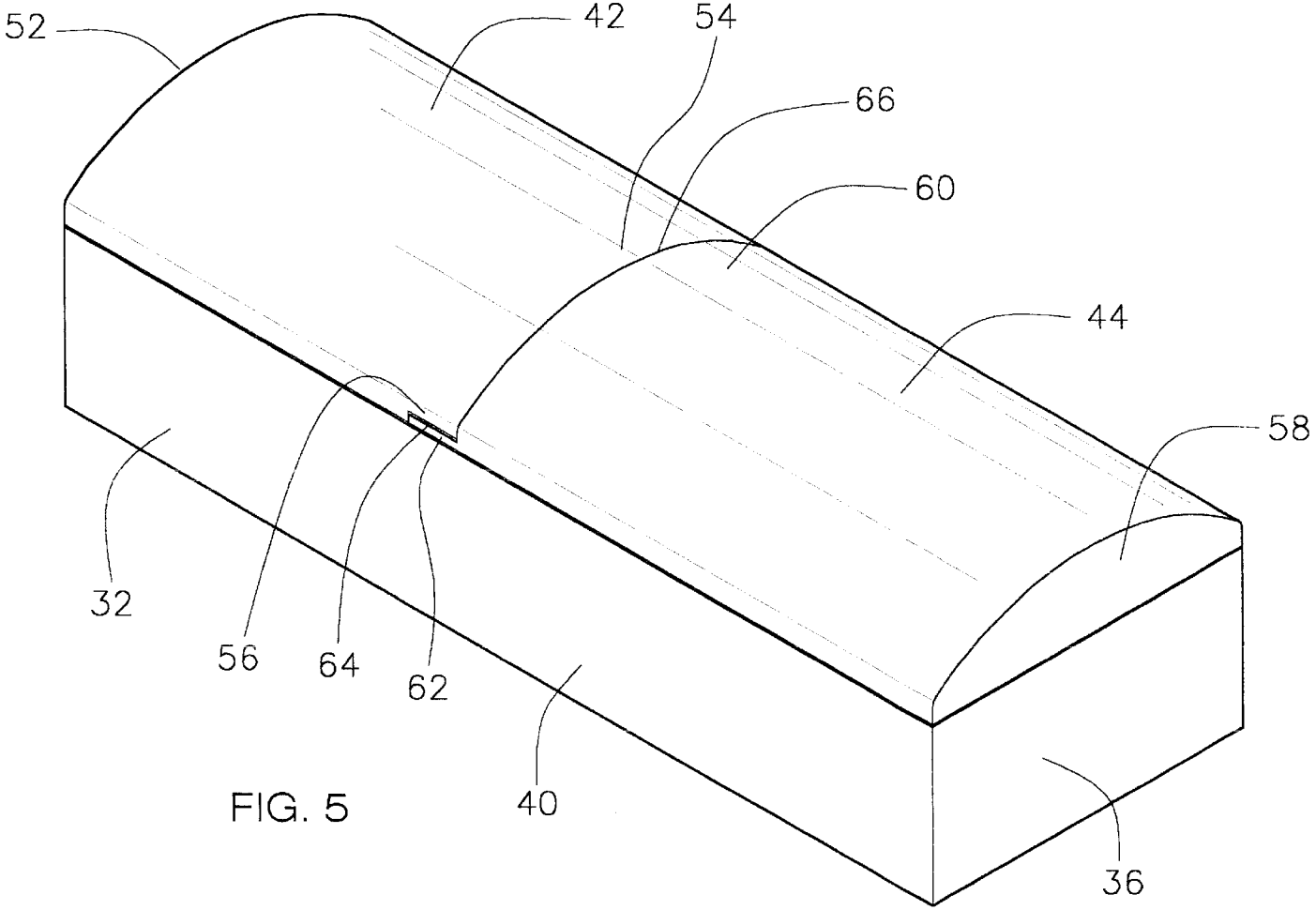
FIG. 5 is an oblique view of the preferred embodiment of the reusable coffin during movement of the vault from the casket.

Following a funeral service, the reusable coffin 10 opens to remove the sealed vault 32 for final disposition. FIG. 5 illustrates the casket 12 with the first lid 22 and the second lid 24 open. Upon releasing the latching means 30, the right sidewall 20 opens as well. With the casket open, the sealed vault 32 can be removed over the right sidewall 20.

In use, it can now be understood that the coffin 10 remains in storage empty. For a funeral, the first lid 22, the second lid 24, and the right sidewall 20 of the casket 12 open. The right sidewall 20 opens by releasing the latching means 30 and lowering the right sidewall 20. The first lid 22 and the second lid 24 open by raising them. A funeral worker then places a vault 32 into the casket 12 and checks that the vault 32 fits snugly within the casket 12. The funeral worker then closes the right sidewall 20, secures the latching means 30, and then opens the first lid 42 and the second lid 44 of the vault 32. The first lid 42 and the second lid 44 of the vault 32 match the first lid 42 and the second lid 44 of the casket. With the reusable coffin 10 open, a funeral may proceed in a normal manner. Following a funeral, a funeral worker removes the protective strip 68 and exposes the sealant 64. The funeral worker then closes the first lid 42 upon the second lid 44 of the vault 32. Releasing the latching means 30, the funeral worker lowers the right sidewall 20 of the casket to remove the vault 32 for final disposition.

While a preferred embodiment of the reusable coffin has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, or wood with or without steel lining, may be used instead of the metal casket described. Also, the vault may be made of concrete, metal, or similar material. From crematory use, the vault may be made of wood, cardboard, or similar material. The disclosed embodiment has illustrated and described a side loading casket: any side, be it right, left, front or rear could be hinged and used to load the vault without departing from the spirit and scope of the invention. Although a casket separated from the vault and reused has been described, it should be appreciated that the reusable coffin herein described is also suitable for underground storage. Furthermore, a wide variety of decorations may be used upon the casket instead of the plain casket described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reusable coffin, comprising:

a casket having a headwall, a footwall, a left sidewall, a right sidewall, a first lid, a second lid, and a bottom interconnected to form a container; and, a vault suitable for temporary placement closely within said casket so as to form a reusable coffin, said vault having a headwall, a footwall, a left sidewall, a right sidewall, a first lid, a second lid, and a bottom, said first lid of said vault having one or more hinges, an outer end, an inner end, and a lip, said second lid of said vault having one or more hinges, an outer end, an inner end, and a lip, and said vault suitable for receiving a deceased person and for viewing a deceased person.

2. The reusable coffin of claim 1 further comprising:

said hinges of said first lid mounting to said first lid of said vault and said left sidewall of said vault, and said lip has less than the thickness of said first lid and extends away from said inner end; and, said hinges of said second lid mounting to said second lid of said vault and said left sidewall of said vault, and said lip has less than the thickness of said second lid, extends away from said inner end, and has a sealant protected by a strip.

3. The reusable coffin of claim 2 wherein said lip of said first lid overlaps said lip of said second lid, and said lip of said first lid removably rests upon said lip of said second lid forming a seam along said inner end when both said first lid and said second lid are closed, said seam is transverse to the longitudinal axis of said vault.

4. The reusable coffin of claim 2 whereby said lip of said first lid seals to said lip of said second lid upon removal of said strip and contact with said sealant.

5. The reusable coffin of claim 4 wherein said sealant is selected from the group consisting of epoxy, glue, resin, tar, pitch, and contact cement.

6. The reusable coffin of claim 4 wherein said strip is selected from the group consisting of paper, metal foil, and plastic film.

7. The reusable coffin of claim 2 wherein said vault is adapted to be hermetically sealed to protect the deceased person.

8. The reusable coffin of claim 2 wherein said vault is selected from the group consisting of plastic, concrete, and metal.

9. The reusable coffin of claim 2 wherein said vault is selected from the group consisting of cardboard and wood.

10. A method of reusing a coffin having a casket with a first lid, a second lid, and a right sidewall with hinges, and a vault with a first lid, a second lid, a lip upon said first lid and a lip upon said second lid wherein the lip of said first lid and the lip of said second lid overlap, the steps comprising:

raising said first lid and said second lid of said casket; and, opening said right sidewall of said casket upon hinges; and, placing said vault over said right sidewall into said casket; and, closing said right sidewall of said casket; and, raising said first lid and said second lid of said vault to receive and to view the deceased; and, following services, closing said first lid and said second lid of said vault wherein an adhesive seals the lip of said first lid of said vault upon the lip of said second lid of said vault; and, opening said right sidewall of said casket upon said hinges; and, removing said vault from said casket over said right sidewall; and, closing said right sidewall of said casket; and, storing said casket for fixture use.

* * * * *